United States Patent [19]

Martin

[11] 4,437,835

[45] Mar. 20, 1984

[54] METHOD OF AND APPARATUS FOR MEASURING THE RATE AT WHICH GASES ARE BLOWN INTO A ROTARY KILN

[75] Inventor: Clovis L. Martin, Sao Jeronimo, Brazil

[73] Assignees: Acos Finos Piratini S.A., Porto Alegre, Brazil; Metallgesellschaft Aktiengesellschaft, Frankfurt am Main, Fed. Rep. of Germany

[21] Appl. No.: 398,800

[22] Filed: Jul. 16, 1982

[30] Foreign Application Priority Data

Jul. 18, 1981 [DE] Fed. Rep. of Germany ..... 3128556

[51] Int. Cl.[3] ..... F27B 7/00

[52] U.S. Cl. ..... 432/103; 432/19; 432/24; 432/47; 432/113

[58] Field of Search ..... 432/19, 24, 26, 47, 432/103, 113, 117

[56] References Cited

U.S. PATENT DOCUMENTS

| | | | |
|---|---|---|---|
| 3,847,538 | 11/1974 | Rossi | 432/113 |
| 3,888,621 | 6/1975 | Williams | 432/26 |
| 3,966,560 | 6/1976 | Farago et al. | 432/26 |
| 4,208,181 | 6/1980 | Rossi | 432/26 |
| 4,345,896 | 8/1982 | Abernathy, Jr. et al. | 432/103 |
| 4,354,829 | 10/1982 | Estes | 432/117 |

FOREIGN PATENT DOCUMENTS

| | | |
|---|---|---|
| 1236216 | 9/1967 | Fed. Rep. of Germany . |
| 1927650 | 12/1970 | Fed. Rep. of Germany . |
| 2164563 | 1/1974 | Fed. Rep. of Germany . |
| 2357834 | 6/1974 | Fed. Rep. of Germany . |
| 2334676 | 1/1975 | Fed. Rep. of Germany . |
| 2357057 | 12/1976 | Fed. Rep. of Germany . |
| 2354605 | 2/1977 | Fed. Rep. of Germany . |
| 2602070 | 4/1977 | Fed. Rep. of Germany . |
| 2918308 | 11/1980 | Fed. Rep. of Germany . |

*Primary Examiner*—Henry C. Yuen

*Attorney, Agent, or Firm*—Karl F. Ross; Herbert Dubno

[57] ABSTRACT

Gases are blown into the kiln through its shell by means of shell pipes or nozzle blocks. The rates at which gases actually enter the kiln are ascertained in that the pressure in each supply duct is pneumatically tapped at a constriction and is applied to a transducer, which is secured to the kiln. A differential pressure is ascertained by the transducer and converted to an electric signal, which is delivered to a control station via slip rings, which are secured to the kiln, and stationary taps.

12 Claims, 1 Drawing Figure

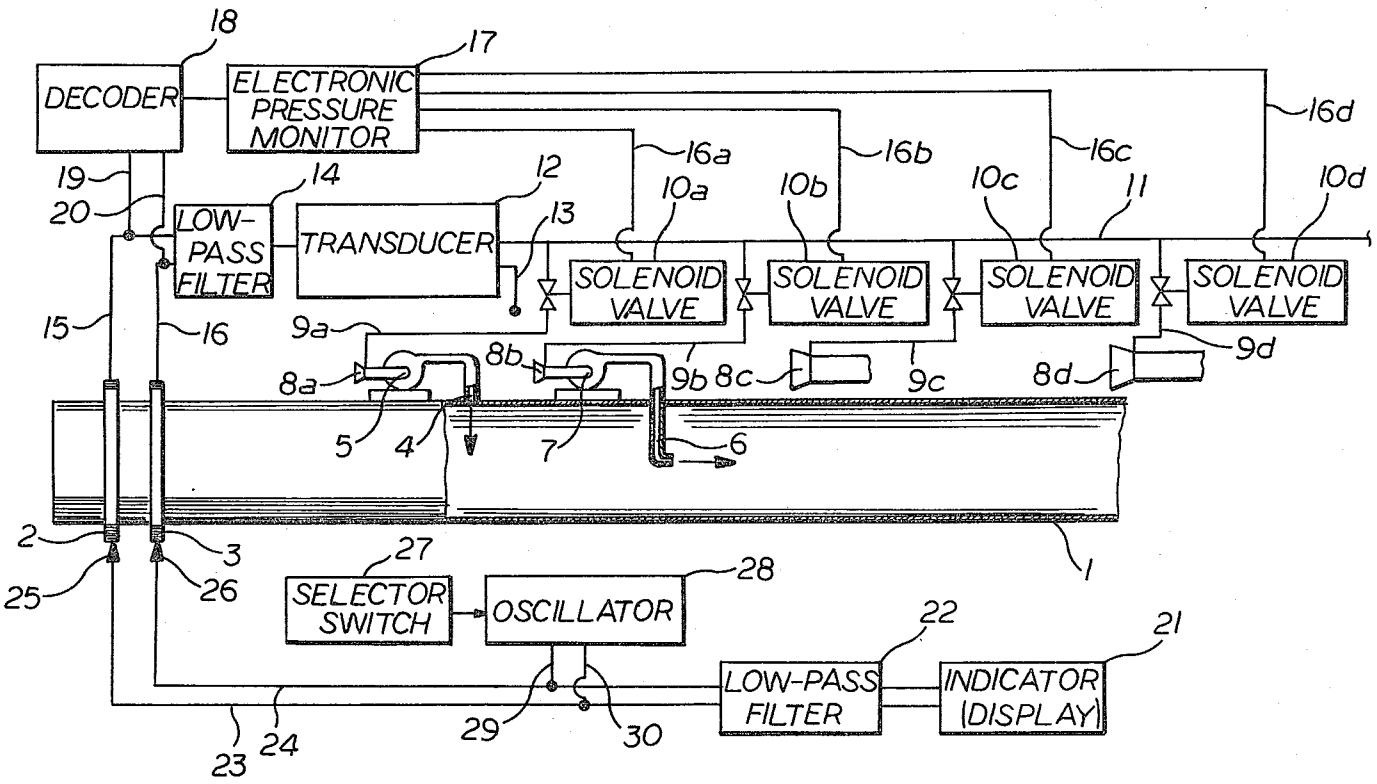
SOLENOID VALVE
SOLENOID VALVE
SOLENOID VALVE
SOLENOID VALVE
ELECTRONIC PRESSURE MONITOR
TRANSDUCER
LOW-PASS FILTER
DECODER
INDICATOR (DISPLAY)
LOW-PASS FILTER
OSCILLATOR
SELECTOR SWITCH
1
2
3
4
5
6
7
8a
8b
8c
8d
9a
9b
9c
9d
10a
10b
10c
10d
11
12
13
14
15
16
16a
16b
16c
16d
17
18
19
20
21
22
23
24
25
26
27
28
29
30

METHOD OF AND APPARATUS FOR MEASURING THE RATE AT WHICH GASES ARE BLOWN INTO A ROTARY KILN

FIELD OF THE INVENTION

My present invention relates to a method of measuring the rate at which gases are blown in streams into a rotary kiln (rotary-tube furnace) through its shell at controlled rates by means of shell pipes (shell tubes) or nozzle blocks.

BACKGROUND OF THE INVENTION

Oxygen-containing or combustible gases are blown into a rotary kiln through its shell or mantle by means of shell pipes (shell tubes) or nozzle blocks at various locations which are distributed over the length of the rotary kiln.

Shell pipes extend radially through the shell of the kiln and have outlets disposed approximately at the center of the kiln (or inwardly of the kiln wall) so that these outlets always lie in the free kiln space.

The shell pipes may consist of simple pipes which are used to inject oxygen-containing gases, generally air, or may comprise shell burners for injecting combustible gases.

Nozzle blocks also extend radially through the shell of the kiln but their outlet openings are substantially flush with the inner surfaces of the lining of the kiln so that they may be temporarily covered by the charge of the kiln.

In most cases, several nozzle blocks form an annular series. Air is usually supplied by blowers, which are mounted on and revolve with the wall of the kiln. Combustible gases must be supplied through wiping seals at the ends of the kiln.

In numerous processes carried out in rotary kilns, particularly the direct reduction of iron oxides at temperatures below the softening point of the charge to produce sponge iron, the temperature profile in the kiln must be exactly controlled; this requires an exact control of the rates at which gases are injected at various locations.

It is known to measure the temperatures at various locations spaced along the rotary kiln by thermocouples and to supply the signal currents thus obtained to a control station via a closed (endless) slip ring, a segmented slip ring and stationary taps.

Reference may be had to U.S. Pat. No. 4,118,986, the art cited therein and the references of its class and subclass. Each thermocouple can be connected at one terminal to one of the segments.

The kiln is provided with shell pipes, which are spaced along the kiln and associated with the respective thermocouples. Each shell pipe is supplied with air from a shell blower.

The rate at which air is supplied to each shell pipe is controlled by a throttle valve which is connected to the control station by similar slip rings and receives from the control station a control command in dependence on the measured temperature (German Patent Publication No. 23 57 834).

Opened German application No. 23 34 676 discloses that the throttle valves can be adjusted by three-phase alternating current delivered via three segmented slip rings. The position of the throttle valves is indicated by and checked at additional slip rings. The throttle valves can be also manually adjusted or set.

In that process, air rates which have been ascertained empirically or by calculation are associated with respective positions of the throttle valves. However, particularly where nozzle blocks are used, these air rates may change as a result of deposits formed at the outlet openings or of changes of the pressure in the kiln so that air at rather different rates may be injected for a given position of the throttle valves. In addition, wrong control actions may be caused by errors made in the measurement of temperatures and such errors may be due to deposits upon thermocouples.

It is also known that the gas rate can be measured by a measuring instrument which comprises a float, which is disposed in a frustoconical passage and is raised to a greater or lesser extent depending on the rate at which gas flows through.

A hollow needle is secured to the float and indicates the gas rate in a sight tube. Shortly above the mark corresponding to the desired gas rate, an adjustable stop is provided for limiting the rise of the hollow needle so that the float cannot fall during the rotation of the kiln and permit gas to enter the kiln at much higher rates. This instrument can be used for an exact measurement only when the instrument is at the top of the kiln in a vertical orientation. Besides, the stop which limits the rise of the hollow needle must be adjusted whenever the desired rate is changed (German patent specification No. 12 36 216).

OBJECTS OF THE INVENTION

It is an object of the invention to permit a reliable measurement of the rates at which gases are blown into the rotary kiln at various locations and to accomplish this with an expenditure which is as small as possible.

Still another object of the invention is to provide an improved method of measuring the rate at which gas is blown into a rotary kiln so as to avoid disadvantages of earlier methods.

Another object is to provide an improved system for this purpose.

SUMMARY OF THE INVENTION

These objects are accomplished in accordance with the invention in that the gas pressure in the supply ducts leading to the shell pipes or nozzle blocks is pneumatically tapped behind a constriction in the supply duct and is applied to a transducer, which is secured to the kiln, a differential pressure is measured and converted by the transducer to electric signals, and these electric signals are delivered to a control station via slip rings, which are secured to the kiln, and stationary taps.

The supply ducts leading to the shell tubes or nozzle blocks are constricted by an orifice plate, nozzle, or venturi tube. The pressure built up in the gas stream as a result of the constriction is pneumatically tapped by a duct and applied to the transducer, where the difference between the pressure and a static second gas pressure is measured.

The static second gas pressure can be tapped in the supply duct before the constriction and be applied to the transducer by a second duct. Alternatively, the second gas pressure applied to the transducer may be the ambient pressure. The differential pressure which has been measured is converted by the transducer to an electric signal, which is delivered by cables to the slip rings and is taken from the slip rings, e.g. by brushes and delivered by cables to a control station, where it is indicated as a volumetric rate. Where shell blowers are used, the constriction in the supply duct may be disposed at the suction or pressure side of the blower.

According to a feature of the invention, the pressure is pneumatically tapped at a venturi-like constriction in the suction pipe of a shell blower and is applied to the transducer in which the difference between the tapped pressure and the ambient pressure is ascertained. In that case a single duct from the tapping point to the transducer will be sufficient.

According to another feature, the differential pressures associated with all supply ducts are ascertained in one transducer. In that case a single transducer will be required and may be disposed at the most favorable location. By these advantages, the disadvantage residing in the need for longer ducts from the tapping points to the transducer is more than offset.

According to yet another feature of the invention, the electric signals are delivered to the control station via a closed slip ring and a segmented slip ring. The segmented slip ring has segments, which are insulated from each other, in a number which is at least as large as the number of tapping points. Particularly where shell tubes are used that arrangement permits the rates at which gases are injected to be measured at relatively low cost because it is sufficient to measure the gas injection rates during any desired part of a revolution of the kiln. Where nozzle blocks are provided, the segments must be so arranged that the measurement is effected in the desired part of the revolution of the kiln, e.g., when the nozzle block is disposed under the charge.

In another feature of the invention, the electric signals are delivered to the control station via two closed slip rings and the control station delivers an electric control command to sample only the signal associated with a given tapping point at a time. This arrangement affords the advantage that the pressure at each tapping point can be measured when the kiln is in any desired angular position. This is particularly desirable where nozzle blocks are used because a measurement will be possible throughout a revolution.

Where closed slip rings are provided, a preferred further feature resides in that the control commands have predetermined frequencies, which are associated with respective tapping points, and are delivered to a decoder, which is mounted on the kiln and in response to a control pulse causes the opening of a solenoid valve, which is incorporated in the pneumatic duct from the desired tapping point to the transducer whereas the solenoid valves in the pneumatic ducts from all other tapping points remain closed, and the control station and the transducer are preceded by low-pass filters which prevent signals at the control command frequencies to be delivered to the control station and the transducer. For this reason that mode of operation involves only a small expenditure.

The injection rates can be controlled in dependence on the measured rates; such control can be effected by adjusting the throttle valves manually or electrically.

BRIEF DESCRIPTION OF THE DRAWING

The sole FIGURE is a diagrammatic view showing a rotary kiln which comprises a nozzle block, a shell pipe and two additional suction pipes, which are larger and the connection of which to the kiln is not shown. For the sake of clearance, all units mounted on the kiln are shown above the kiln. Stationary units are shown below the kiln.

SPECIFIC DESCRIPTION

The rotary kiln 1 is provided with two closed slip rings 2, 3. The nozzle block 4 is connected to the shell blower 5. The shell pipe 6 is connected to the shell blower 7.

The suction pipe of the shell blower 5 has a venturi-like constriction **8*a*. The suction pipe of the shell blower 7 has a venturi-like constriction 8*b*, and the additional suction pipes have venturi-like constrictions 8*c*, 8*d***.

The pneumatic connecting ducts **9*a* to 9*d* incorporate solenoid valves 10*a* to 10*d* and lead to a manifold 11, which is connected to the transducer 12. The ambient pressure is applied to the transducer 12 via duct 13**.

The transducer 12 is connected to the slip rings 2, 3 by the low-pass filter 14 and the cables 15, 16. The solenoid **10*a* to 10*d* are connected by the cables 16*a* to 16*d* to the electronic unit 17**.

The electronic unit 17 is connected by the decoder 18 and cables 19, 20 to the cables 15, 16. In the control station the indicating instrument 21 is connected to the slip rings 2, 3 via the low-pass filter 22, cables 23, 24 and brushes 25, 26. The switch 27 for selecting the tapping points is connected to the cables 23, 24 by the oscillator 28 and cables 29, 30.

When it is desired to measure the rate at which air is blown through the nozzle block 4, the associated tapping point is selected by the switch 27 so that the oscillator will deliver to the decoder 18 a signal at a frequency of about 1 kHz. That signal is blocked by the low-pass filter 22, (e.g. 200 Hz) preceding the indicating instrument and by the filter 14 preceding the transducer 12. In response to the signal at that frequency, the decoder 18 selects the tapping point associated with the nozzle block 4 and delivers a control command to the electronic unit 17 so that a signal delivered via lead **16*a* causes the solenoid valve 10*a*** to open.

The solenoid valves **10*b* to 10*d* remain closed. The pressure in the venturi tube 8*a* is now applied via the connecting duct 9*a* and the manifold 11 to the transducer 12, where the difference between said pressure and the ambient pressure applied via duct 13 is measured and a corresponding electric signal is generated, which is delivered to the indicating instrument 21** in the control station.

The advantages afforded by the invention reside in that the rates at which gases are actually blown into the kiln at various locations can be measured in a simple but reliable manner so that the operation can be optimized. The gas injection rates can be exactly monitored and can be held constant even during fluctuations of other operating conditions. Besides, the temperature-indicating means can be monitored as well as the operative condition of the injecting means.

I claim:

1. A method of measuring the rate at which gases are blown in streams into a rotary kiln, said method comprising the steps of:

(a) introducing said gases into said kiln in respective streams;

(b) intercepting each of said streams with a constriction before the stream enters said kiln;

(c) pneumatically tapping each stream behind the respective constriction to generate a differential pressure between the pressure of each stream upstream of the respective constriction and a static second gas pressure, said differential pressures representing the flow rate of the respective streams into said kiln;

(d) transducing each differential pressure into respective electrical signals on said rotary kiln whereby each signal represents the flow rate of the respective stream; and (e) tapping said electrical signals from said rotary kiln by slip rings on said kiln and stationary taps engaging said slip rings.

2. The method defined in claim 1 wherein said streams are introduced into said rotary kiln through respective shell blowers and said constrictions are Venturi-like constrictions, the differential pressures being pressure differences between the pressure of each stream upstream of the respective constrictions and ambient pressure constituting said second gas pressure.

3. The method defined in claim 1 wherein a single transducer is provided on said rotary kiln, further comprising the step of successively connecting said differential pressures of said streams to said transducer.

4. The method defined in claim 1, further comprising the step of commutating said electrical signals of said stream sequentially to said slip rings, said slip rings being respectively continuous on said rotary kiln.

5. An apparatus for measuring the rate at which gases are blown in streams into a rotary kiln, said apparatus comprising:

means for introducing said gases into said rotary kiln in respective streams and including ducts traversed by the respective streams;

respective constrictions in said ducts traversed by said streams;

respective means connected to each duct upstream of the respective constrictions for detecting respective differential pressures between the pressure of each stream upstream of the respective constriction and a static second gas pressure, said differential pressures representing the flow rate of gases in the respective streams;

transducer means on said rotary kiln responsive to said differential pressures for transducing the respective differential pressures into respective electrical signals representing the flow rate of the respective streams;

slip rings on said rotary kiln receiving said electrical signals; and stationary taps engaging said slip rings for tapping said electrical signals from said rotary kiln.

6. The apparatus defined in claim 5 wherein said constrictions are Venturi-like constrictions and said means for introducing said gases into said kiln include shell blowers having suction pipes connected to said ducts and provided with Venturi-like constriction, the respective differential pressures being the difference between a pressure upstream of the constriction and ambient pressure constituting said second gas pressure.

7. The apparatus defined in claim 5 wherein said transducer means include a single transducer on said rotary kiln, respective pipes adapted to transmit the respective differential pressures, respective valves connected between said pipes and said transducer, and control means for commutating said valve to selectively connect the respective pipes with said transducer.

8. The apparatus defined in claim 5 wherein said slip rings include an endless slip ring and a segmented slip ring.

9. The apparatus defined in claim 5 wherein said slip rings include a pair of endless slip rings, said taps being connected to a control station sampling the electrical signals associated with a respective stream at appropriate times in the rotation of said kiln.

10. The apparatus defined in claim 9 wherein said control station produces control commands having predetermined frequencies respectively associated with the respective streams and tapping points, said apparatus further comprising a decoder mounted on said kiln and responsive to a control pulse for opening a selected solenoid valve in a respective pneumatic duct running from one of said streams to said transducer means while maintaining other solenoid valves in other pneumatic ducts of other streams closed, said station and said transducer means being preceded by low-pass filters preventing the delivery thereto of said commands at said predetermined frequency.

11. The apparatus defined in claim 5, claim 7, claim 8, claim 9, or claim 10 wherein said means for introducing said gases into said rotary kiln are shell pipes.

12. The apparatus defined in claim 5, claim 7, claim 8, claim 9, or claim 10 wherein said means for introducing said gases into said kiln are nozzle blocks.

* * * * *